US010675830B2

(12) United States Patent
Kay et al.

(10) Patent No.: US 10,675,830 B2
(45) Date of Patent: Jun. 9, 2020

(54) PACKER DEVICE

(71) Applicant: Harris Corporation, Melbourne, FL (US)

(72) Inventors: Steven D. Kay, Greenlawn, NY (US); Jeffrey S. Shapiro, Long Beach, NY (US); Robert E. Hammerquist, Huntington, NY (US); Steven A. Hartney, Farmingdale, NY (US)

(73) Assignee: Harris Corporation, Melbourne, FL (US)

( * ) Notice: Subject to any disclaimer, the term of this patent is extended or adjusted under 35 U.S.C. 154(b) by 537 days.

(21) Appl. No.: 15/370,137

(22) Filed: Dec. 6, 2016

(65) Prior Publication Data

US 2018/0155124 A1 Jun. 7, 2018

(51) Int. Cl.
*B30B 9/30* (2006.01)
*B65F 3/20* (2006.01)

(52) U.S. Cl.
CPC ..... *B30B 9/3064* (2013.01); *B65F 3/201* (2013.01); *B65F 3/207* (2013.01)

(58) Field of Classification Search
CPC ..... B30B 9/3064; B65F 3/201; B65F 3/207
USPC ..... 100/289, 290
See application file for complete search history.

(56) References Cited

U.S. PATENT DOCUMENTS

| | | | | |
|---|---|---|---|---|
| 778,446 | A | 12/1904 | Clarke et al. | |
| 2,002,993 | A * | 5/1935 | Ehrick | B65F 3/28 100/100 |
| 2,103,128 | A | 12/1937 | Walter | |
| 2,808,158 | A | 10/1957 | Gilleo | |
| 2,909,295 | A | 10/1959 | Weir | |
| 3,074,571 | A | 1/1963 | Dean | |
| 3,239,084 | A | 3/1966 | Barnett | |
| 3,456,777 | A | 7/1969 | Sagmeister | |
| 3,643,589 | A | 2/1972 | Carter | |
| 3,911,810 | A | 10/1975 | Standbridge | |

(Continued)

FOREIGN PATENT DOCUMENTS

FR 2503028 A1 10/1982

OTHER PUBLICATIONS

European Search Report in corresponding European Patent Application No. 17001934.3, dated Apr. 12, 2018.

*Primary Examiner* — Elaine Gort
*Assistant Examiner* — Christopher B Wehrly
(74) *Attorney, Agent, or Firm* — Edell, Shapiro & Finnan, LLC

(57) ABSTRACT

The present invention is directed toward a new and improved compactor or packer. The compactor, which may be used to compact refuse, includes a container, a track disposed within the container, and a ball screw rotatably disposed within the track. The compactor further includes a ball nut operatively coupled around the ball screw, where rotation of the ball screw causes the ball nut to move along or traverse the ball screw. A packer blade is coupled to the ball nut via a floating interface. Movement of the ball nut long the ball screw due to rotation of the ball screw forces the packer blade to move within the container. The floating interface allows the packer blade to float within the container with respect to the ball nut to reduce the likelihood of binding of the ball nut on the ball screw as the packer blade traverses within the container.

20 Claims, 10 Drawing Sheets

(56) References Cited

U.S. PATENT DOCUMENTS 3,995,543 A * 12/1976 Montalbano ..... B30B 9/30
100/343
4,136,610 A * 1/1979 Tyler, Jr. ..... B30B 9/30
100/100
5,341,731 A * 8/1994 Grizzard, Jr. ..... B30B 9/3003
100/100

* cited by examiner

PACKER DEVICE

FIELD OF THE INVENTION

The present invention relates to packer device to compact items placed in a container, such as the rear of a refuse truck. More specifically, the present invention relates to a refuse truck with a packer (also called a "compactor") used to compact refuse items disposed within the container of a refuse truck.

BACKGROUND OF THE INVENTION

Refuse compaction systems, which are typically constructed as a steel partition driven by telescopic hydraulic rams, are the leading maintenance items in the refuse hauling industry. These conventional compaction systems, which work in a hazardous and dirty environment, repeatedly suffer hydraulic leaks, hydraulic fluid contamination, and jams. In addition, the very large telescoping hydraulic rams typically used in these systems contain multiple extension stages that move very slowly due to their large fluid displacements and the limitations of the power take-off pumps. This increases the compaction time of conventional compaction system. In addition, because the conventional compaction systems are constructed from telescoping cylindrical arms in a cross configuration, as the cylindrical arms extend, each engaged stage of the cylindrical arm also reduces the overall packing force the system can apply. Finally, conventional compaction systems are heavy (i.e., increasing fuel consumption of the refuse truck), and require large volumes of hydraulic fluid to produce the required compaction forces.

Accordingly, it would be desirable to provide a compaction system (e.g., a "packer"), including a refuse compaction system, with low friction, a fast cycle time, and that requires lower maintenance compared to conventional hydraulic compaction systems. Additionally, it would be desirable to provide a compaction system that is capable of providing a full compaction load across the whole displacement range of the packer blade, while being of a lighter construction than that of conventional compaction systems.

SUMMARY OF THE INVENTION

The present invention is directed toward a new and improved compactor. The compactor includes a container, a track disposed within the container, and a ball screw rotatably disposed within the track. The refuse compactor further includes a ball nut operatively coupled around the ball screw, where rotation of the ball screw causes the ball nut to move along or traverse the ball screw. A ball screw assembly generally consists of a ball screw and a ball nut, each with matching helical grooves, and balls which roll between these grooves providing the only contact between the nut and the screw. As the ball screw rotates, the balls are deflected by a deflector into the ball return system of the ball nut and they travel through the return system to the opposite end of the ball nut in a continuous path. The balls then exit from the ball return system into the ball screw and nut thread raceways continuously to recirculate in a closed circuit.

A packer blade is coupled to the ball nut via a floating interface. Movement of the ball nut long the ball screw due to rotation of the ball screw forces the packer blade to move within the container. The floating interface allows the packer blade to float within the container with respect to the ball nut.

BRIEF DESCRIPTION OF THE DRAWINGS

Like reference numerals have been used to identify like elements throughout this disclosure.

DETAILED DESCRIPTION OF THE INVENTION

Figure 1:
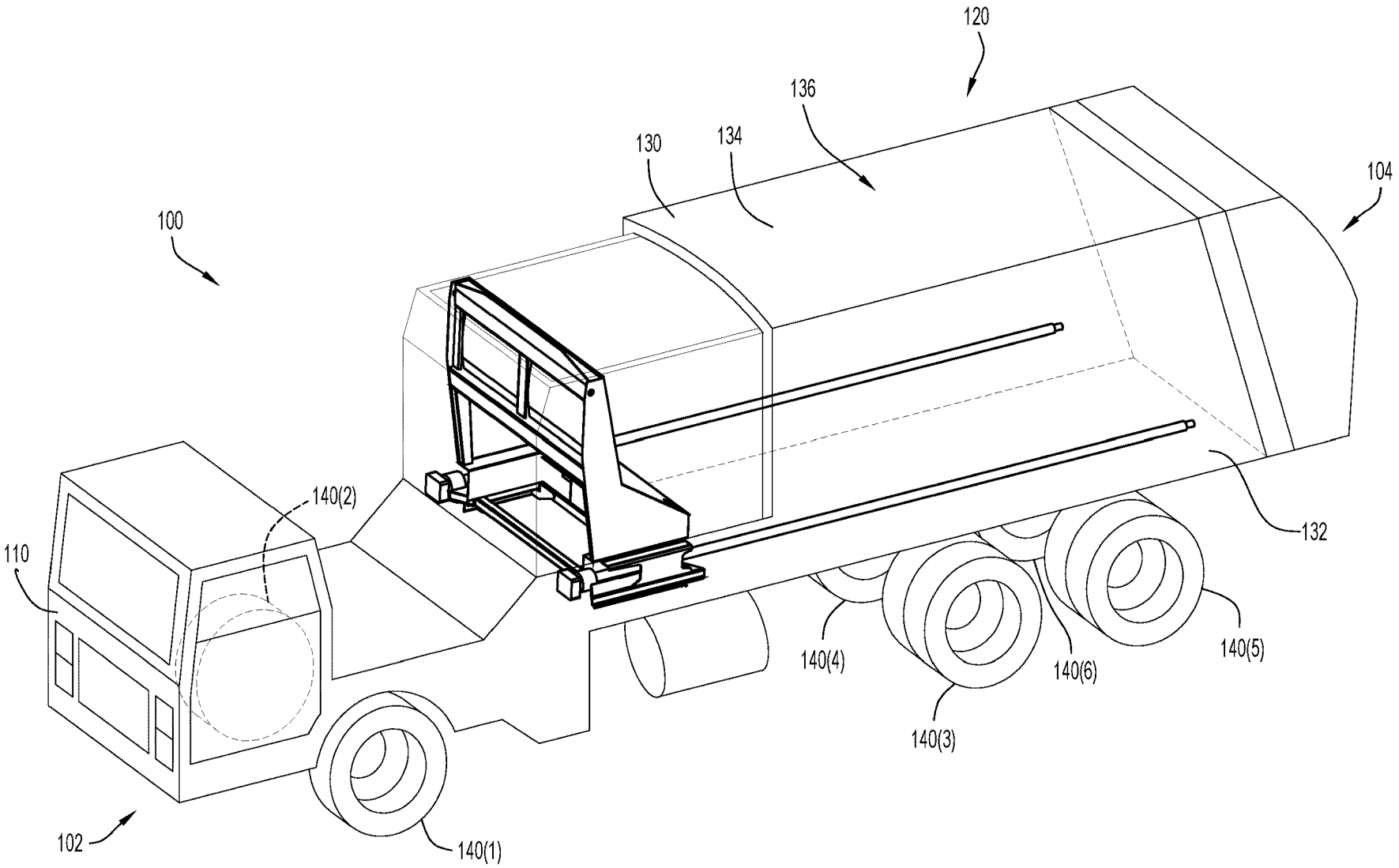
FIG. 1 illustrates a perspective view of a front loaded refuse truck, shown in shadow.
Figure 2:
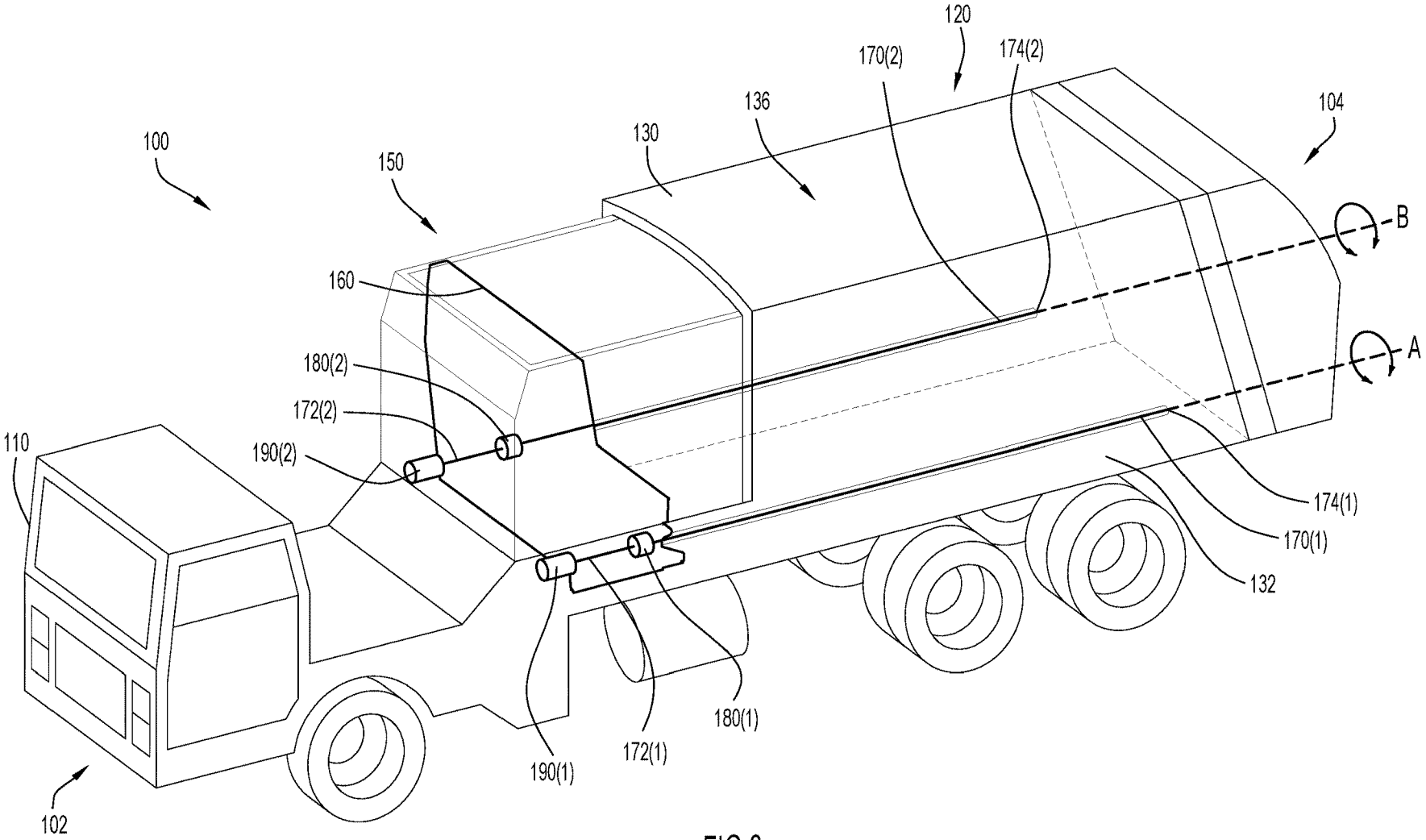
FIG. 2 illustrates a perspective view of the front loaded refuse truck illustrated in FIG. 1, the refuse truck being equipped with a refuse packer in accordance with the present invention.

As illustrated in FIGS. 1 and 2, shown in shadow, a front loading refuse truck 100, which includes a front end 102 and a rear end 104 opposite the front end 102. While FIGS. 1 and 2 illustrate a front loading refuse truck 100, the present invention may be incorporated on any type of packer or compactor, including, but not limited to, rear loading refuse trucks, side loading refuse trucks, stand-alone compactors, etc. The refuse truck 100 includes a cab 110 disposed proximate to the front end 102 of the refuse truck 100. Furthermore, the refuse truck 100 includes a compactor 120 disposed proximate to the rear end 104 of the refuse truck 100, where the compactor 120 includes a container 130. As best illustrated in FIG. 1, the container 130 of the compactor 120 includes an exterior surface 134 and an interior surface 132, where the interior surface 132 of the container 130 includes a plurality of sidewalls that define an interior cavity or chamber 136 configured to retain debris or items (e.g., trash or refuse).

As further illustrated in FIG. 1, the refuse truck 100 also includes a plurality of wheels 140(1)-140(6). A pair of front wheels 140(1), 140(2) is disposed on the refuse truck 100 proximate to the front 102 of the refuse truck 100 such that the pair of front wheels 140(1), 140(2) are disposed at least partially under, and support, the cab 110. Four rear wheels 140(3)-140(6) are disposed proximate to the rear end 104 of the refuse truck 100, such that the four rear wheels 140(3)-140(6) are disposed under, and support, the container 130. The plurality of wheels 140(1)-140(6) support the refuse truck 100 on a support surface, where rotation of the plurality of wheels 140(1)-140(6) causes the refuse truck 100 to travel along a support surface.

As best illustrated in FIG. 2, a transfer mechanism 150 is disposed primarily within the interior cavity 136 of the container 130 of the compactor 120. Among other components described in further detail below, the transfer mechanism 150 includes a packer blade 160, a pair of ball screws 170(1), 170(2), a pair of ball nuts 180(1), 180(2), and a pair of drive mechanisms 190(1), 190(2). Each of the ball screws 170(1), 170(2) include a first end 172(1), 172(2), respectively, and a second end 174(1), 174(2), respectively. The ball screws 170(1), 170(2) span the length of the interior cavity 136 of the container 130, where the first ends 172(1), 172(2) are disposed closer to the front end 102 of the refuse truck 100 than the second ends 174(1), 174(2). Thus, the ball screws 170(1), 170(2) extend through the interior cavity 136 of the container 130 in the lengthwise direction (i.e., the direction spanning from the front end 102 to the rear end 104 of the refuse truck 100, or vice versa). A drive mechanism 190(1), 190(2) is coupled to each of the first ends 172(1), 172(2) of the ball screws 170(1), 170(2), respectively. Drive mechanism 190(1) drives ball screw 170(1) to rotate about longitudinal axis A, while drive mechanism 190(2) drives ball screw 170(2) to rotate about longitudinal axis B. Drive mechanisms 190(1), 190(2) drive rotation of the ball screws 170(1), 170(2) in either a first direction (e.g., clockwise) about axes A, B or a second direction (e.g., counter-clockwise) about axes A, B. As illustrated in FIG. 2, and as further detailed below, the ball nuts 180(1), 180(2) are coupled to the packer blade 160, while also being operatively coupled around the ball screws 170(1), 170(2), respectively. Thus, as the drive mechanisms 190(1), 190(2) drive the rotation of the ball screws 170(1), 170(2), respectively, the rotation of the ball screws 170(1), 170(2) causes the ball nuts 180(1), 180(2) to traverse along the length of the ball screws 170(1), 170(2). Because the packer blade 160 is coupled to the ball nuts 180(1), 180(2), as the ball nuts 180(1), 180(2) traverse along the ball screws 170(1), 170(2), the packer blade 160 traverses along the length of interior cavity 136 of the container 130.

As further detailed below, traversing of the ball nuts 180(1), 180(2) toward the rear end 104 of the refuse truck 100 causes the packer blade 160 to traverses the interior cavity 136 of the container 130 toward the rear end 104 of the refuse truck 100. When the packer blade 160 traverses toward the rear end 104 of the refuse truck 100, the packer blade 160 compacts, packs, or compresses debris or items disposed within the interior cavity 136 of the container 130. Conversely, after the packer blade 160 has traversed towards the rear end 104 of the refuse truck 100, traversing of the ball nuts 180(1), 180(2) back along the length of the ball screws 170(1), 170(2) toward the front end 102 of the refuse truck 100 causes the packer blade 160 to also traverse the interior cavity 136 of the container 130 toward the front end 104 of the refuse truck 100.

Figure 3A:
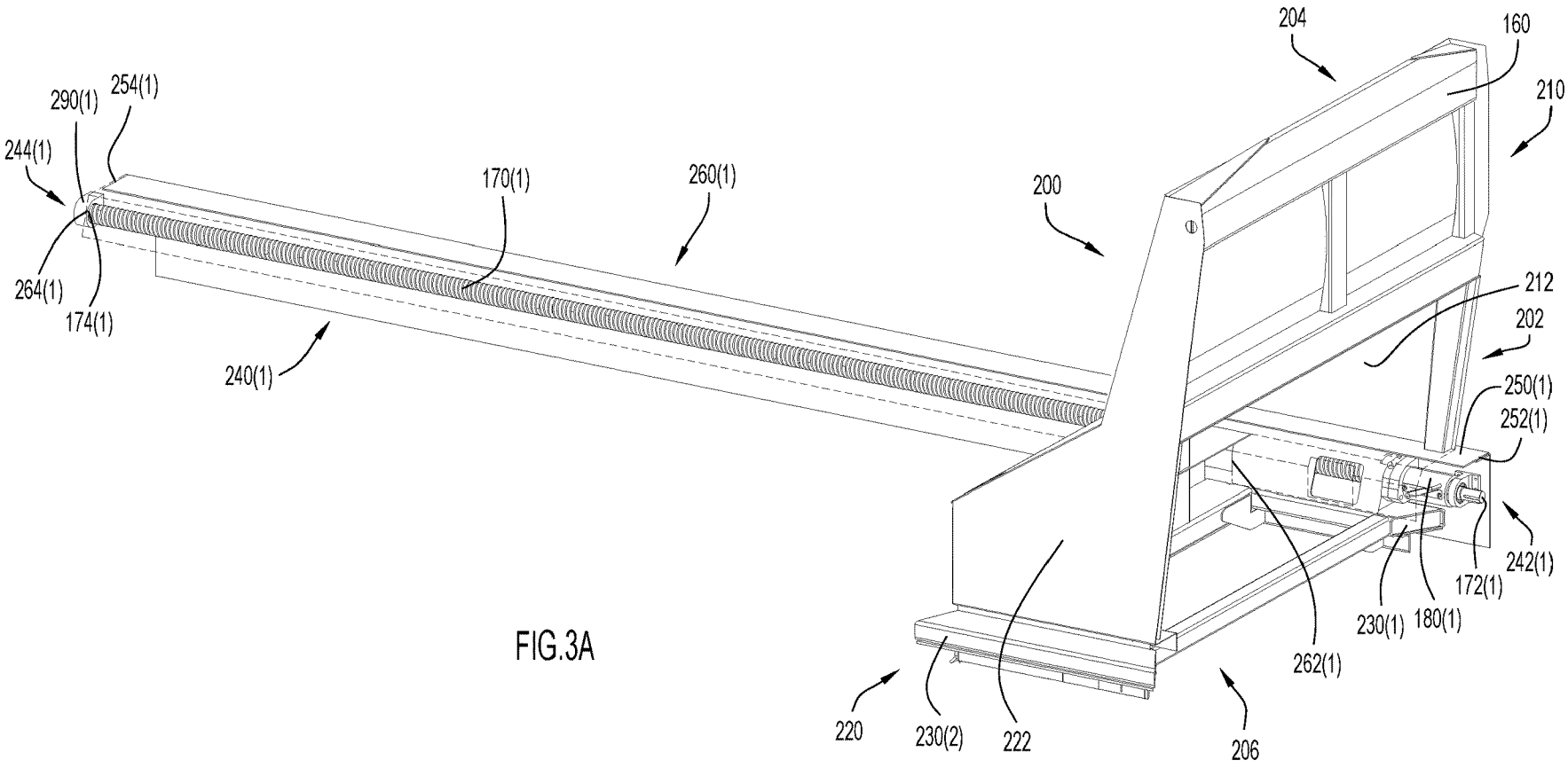
FIG. 3A illustrates an isolated perspective view of the packer blade and transfer mechanism of the embodiment of the refuse packer illustrated in FIG. 2.
Figure 3B:
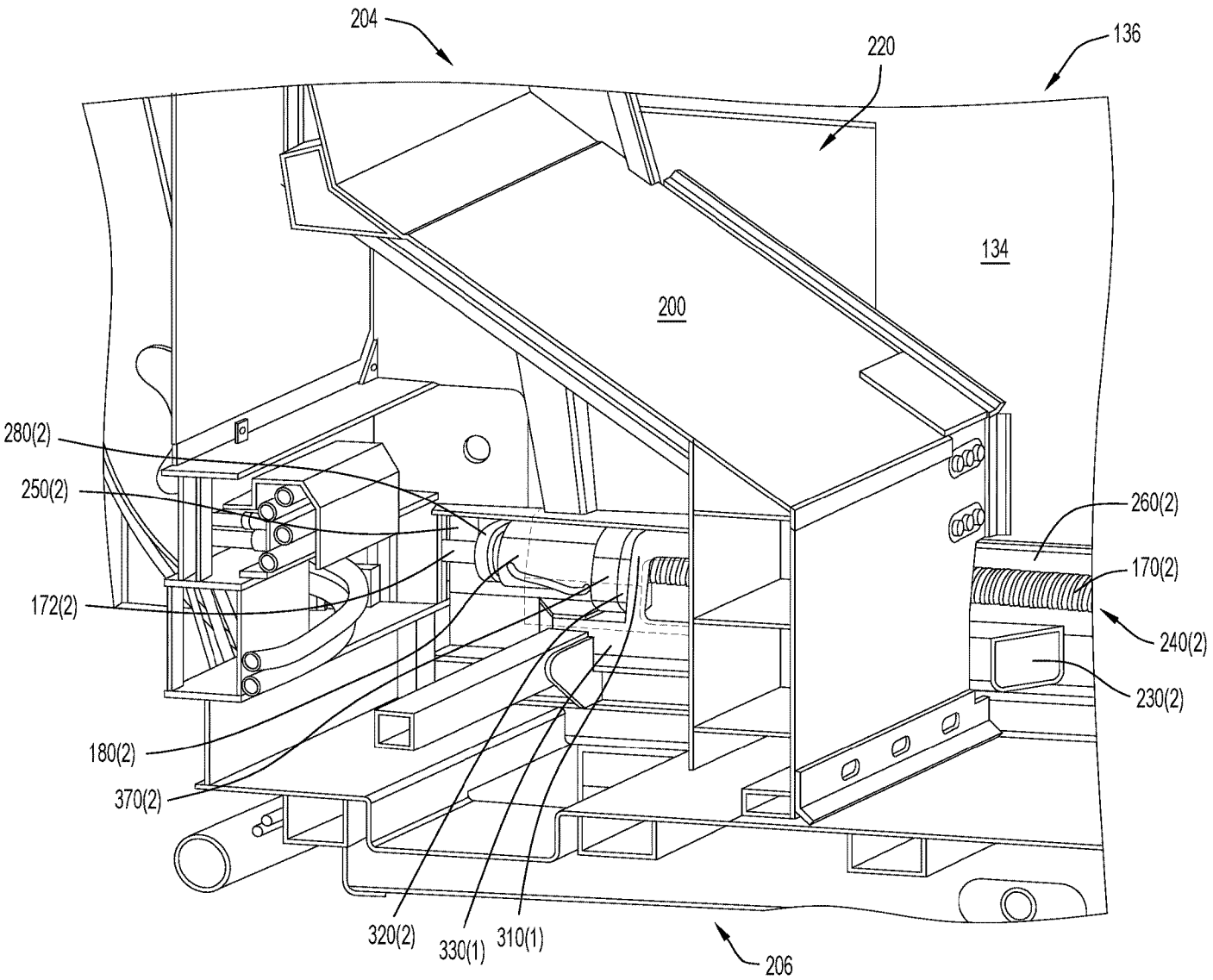
FIG. 3B illustrates a cut-away perspective view of the packer blade and transfer mechanism of the embodiment of the refuse packer illustrated in FIG. 2.

FIGS. 3A and 3B further illustrate the packer blade 160 being operatively coupled to the ball screw 170(1) via ball nut 180(1) and the ball screw 170(2) via ball nut 180(2). As illustrated in FIGS. 3A and 3B, the packer blade 160 includes a front end 200, an opposite rear end 202, a top end 204, an opposite bottom end 206, a first side 210, and an opposite second side 220. The first side 210 contains a first sidewall 212, while the second side 220 contains a second sidewall 222. As further detailed below, a pair of transfer plates 230(1), 230(2) are coupled to the packer blade 160. The first transfer plate 230(1) is coupled to the first sidewall 212 of the packer blade 160 proximate to the bottom end 206 of the packer blade 160. Similarly, the second transfer plate 230(2) is coupled to the second sidewall 222 of the packer blade 160 proximate to the bottom end 206 of the packer blade 160. The first and second transfer plates 230(1), 230(2) extend from the front end 200 to the rear end 202 through the sidewalls 212, 222, respectively. Ball nut 180(1) is coupled to the packer blade 160 via the first transfer plate 230(1), while ball nut 180(2) is coupled to the packer blade 160 via the second transfer plate 230(2).

Figure 4:
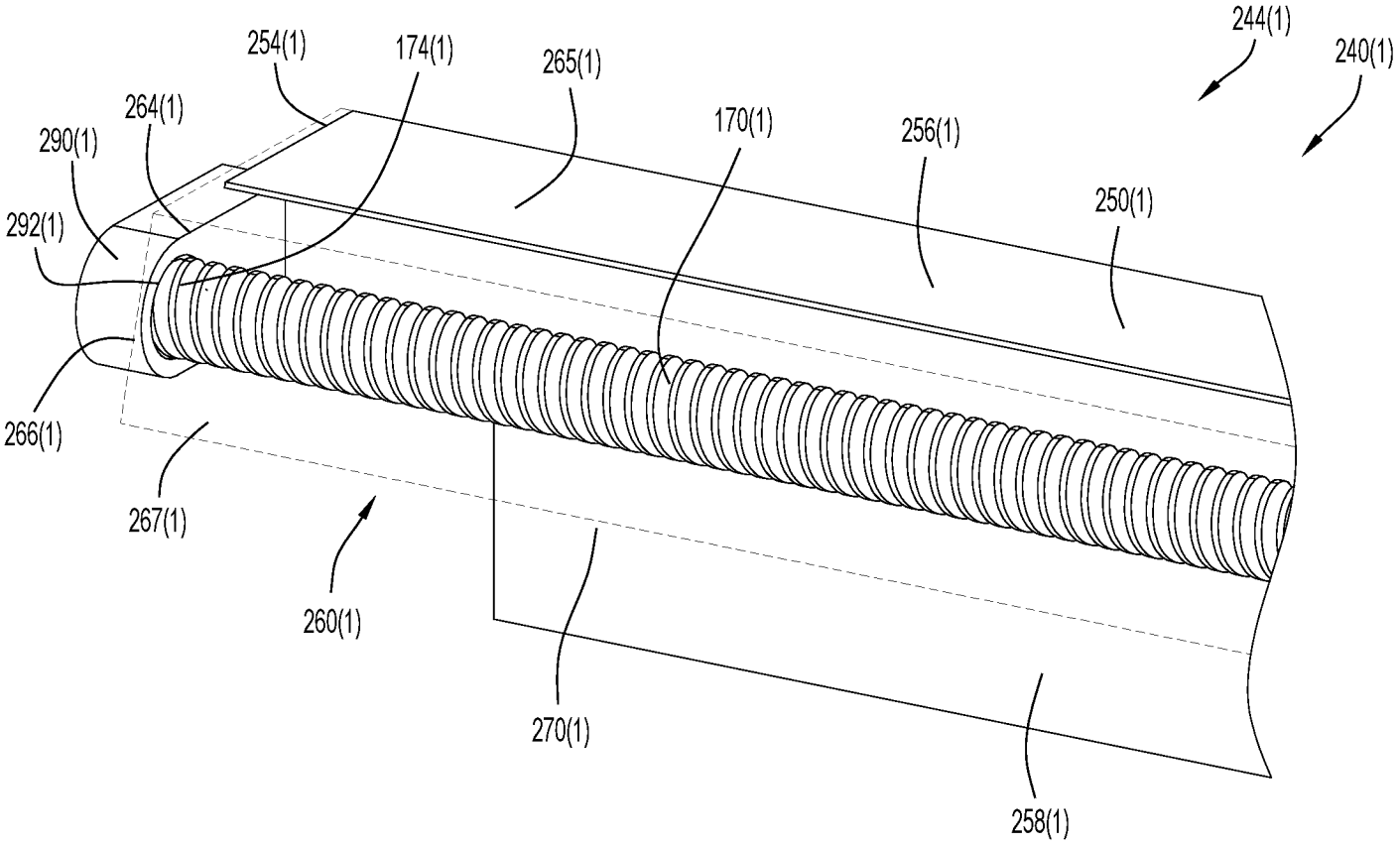
FIG. 4 illustrates a transparent perspective view of one end of the track of the transfer mechanism illustrated in FIG. 3A.

As previously explained, the packer blade 160 is configured to traverse along the ball screws 170(1), 170(2) as the ball nuts 180(1), 180(2) coupled to the packer blade 160 traverse the ball screws 170(1), 170(2), respectively. As best illustrated in FIGS. 3A, 3B, and 4, the ball screws 170(1), 170(2) are disposed within tracks 240(1), 240(2). While FIGS. 3A and 4 illustrate only the first track 240(1), the discussion of the first track 240(1) applies to the second track 240(2), as the first track 240(1) and the second track 240(2) are substantially similar and may be mirror images of one another. First track 240(1) contains a first end 242(1) and a second end 244(1). Furthermore, first track 240(1) includes outer bracket 250(1) and debris cover 260(1). Outer bracket 250(1) includes a first end 252(1) and a second end 254(1). The first end 252(1) of the outer bracket 250(1) is disposed proximate to the first end 242(1) of the first track 240(1), while the second end 254(1) of the outer bracket 250(1) is disposed proximate to the second end 244(1) of the first track 240(1). Thus, the outer bracket 250(1) and the first track 240(1) are be substantially equal in length.

As illustrated in FIG. 4, the outer bracket 250(1) further includes a top portion 256(1) and a bottom portion 258(1). The top portion 256(1) and the bottom portion 258(2) are coupled to one another such that the bottom portion 258(1) intersects the top portion 256(1) at a right angle and the outer bracket 250(1) is substantially L-shaped. In other words, the top portion 256(1) is substantially horizontal, while the bottom portion 258(1) is substantially vertical. The outer bracket 250(1) may be coupled to the interior surface 132 of the container 130, or may be integrally formed on the interior surface 132 of the container 130.

The debris cover 260(1) is coupled to the outer bracket 250(1), where the debris cover 260(1) and the outer bracket 250(1) collectively form the first track 240(1). As illustrated, the debris cover 260(1) includes a first end 262(1) and an opposite second end 264(1). While the second end 264(1) of the debris cover is disposed proximate to the second end 244(1) of the first track 240(1) and the second end 254(1) of the outer bracket 250(1), the first end 262(1) of the debris cover is spaced from the first ends 242(1), 252(1) of the first track 240(1) and the outer bracket 250(1), respectively. As best illustrated in FIG. 4, the debris cover 260(1), which is shown in phantom to illustrate the ball screw 170(1) disposed between the debris cover 260(1) and the outer bracket 250(1), includes a top section 265(1), an intermediate section 266(1), and a bottom section 267(1). The top section 265(1) of the debris cover 260(1) is coupled to the top portion 256(1) of the outer bracket 250(1). In one embodiment, the top section 265(1) of the debris cover 260(1) is disposed on top of the top portion 256(1) of the outer bracket 250(1). The intermediate section 266(1) descends from the top section 265(1) at an angle offset from 90 degrees, and is positioned opposite of the bottom portion 258(1) of the outer bracket 250(1). Finally, the bottom section 267(1) descends from the intermediate section 266(1), such that the bottom section 267(1) is substantially vertical like that of the bottom portion 258(1) of the outer bracket 250(1).

As best illustrated in FIG. 4, the outer bracket 250(1) and the debris cover 260(1) form a protective canopy over the ball screw 170(1), where the ball screw 170(1) is disposed in the cavity 270(1) formed by the outer bracket 250(1) and the debris cover 260(1). With the top portion 256(1) of the outer bracket 250(1) being coupled to the top section 265(1) of the debris cover 260(1), and the bottom portion 258(1) being spaced from the intermediate section 266(1) and the bottom section 267(1) of the debris cover 260(1), a cavity 270(1) is formed by the outer bracket 250(1) and the debris cover 260(1). The ball screw 170(1) is configured to fit within the cavity 270(1) such that the ball screw 170(1) is free to rotate within the cavity 270(1). The combination of the bracket 250(1) and the debris cover 260(1) shields the ball screw 170(1) from any objects or debris within the container 130 that may interact with the ball screw 170(1) damage the ball screw 170(1), or to prevent the ball screw 170(1) from rotating, or to prevent the ball nut 180(1) from traversing along the ball screw 170(1).

Figure 5:
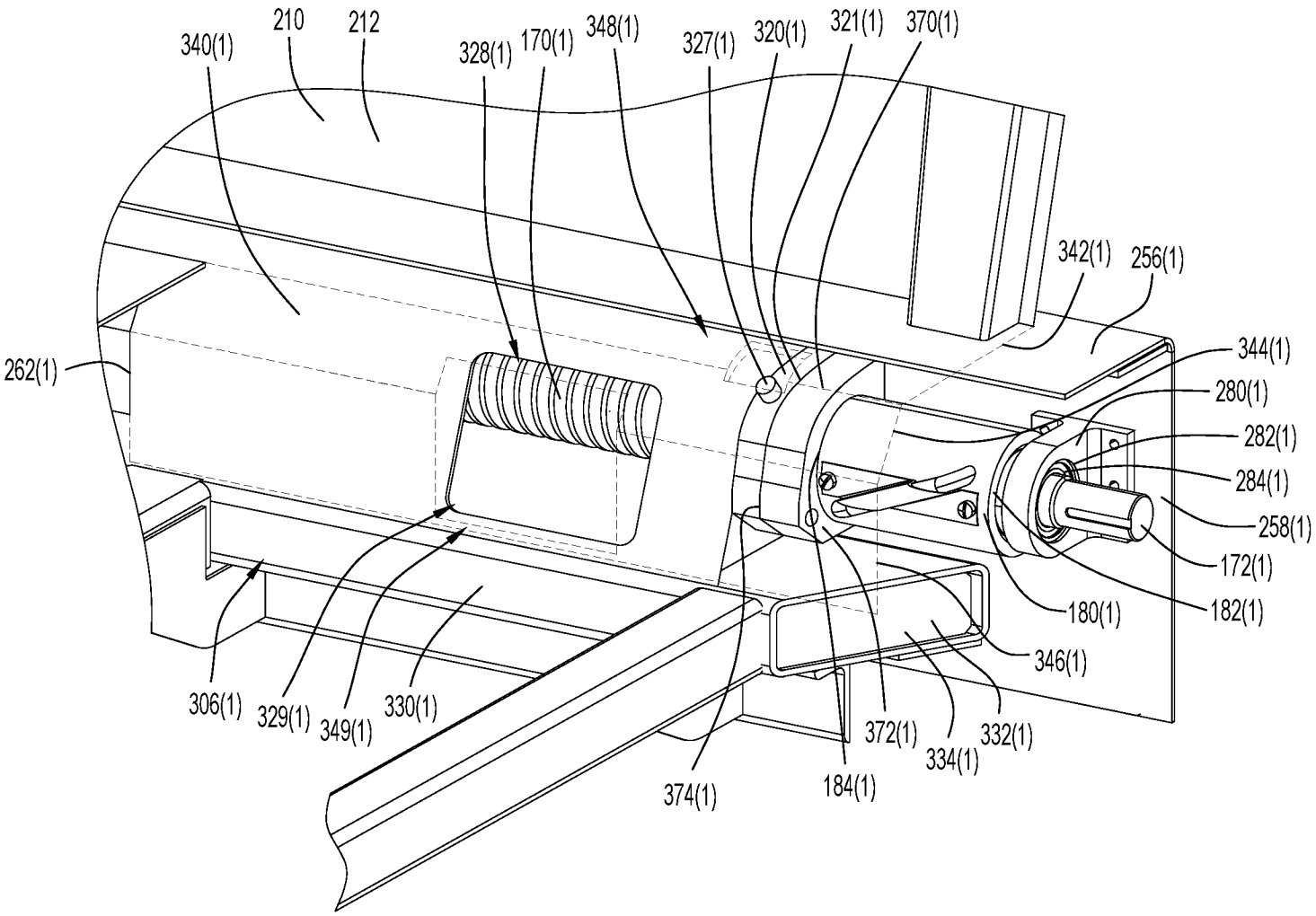
FIG. 5 illustrates a perspective view of another end of the track of the transfer mechanism illustrated in FIG. 3A.

As illustrated in FIGS. 4 and 5, coupled to the outer bracket 250(1) is a pair of bearing blocks 280(1), 290(1). The first bearing block 280(1) is coupled to the bottom portion 258(1) of the outer bracket 250(1) proximate to the first end 252(1) of the outer bracket 250(1). The first bearing block 280(1) is coupled to the bottom portion 258(1) such that the first bearing block 280(1) extends substantially perpendicularly from the bottom portion 258(1) of the outer bracket 250(1). As illustrated in FIG. 5, the first bearing block 280(1) includes an opening 282(1) that extends through the entire bearing block 280(1). Disposed within the opening 282(1) is a bearing 284(1) that is configured to receive the first end 172(1) of the ball screw 170(1). The first end 172(1) of the ball screw 170(1) extends through the bearing 284(1) and the opening 282(1) of the bearing block 180(1) such that the first end 172(1) of the ball screw 170(1) is exposed and capable of being coupled to the drive mechanism 190(1).

Second bearing block 290(1) (see FIG. 4) is coupled to the bottom portion 258(1) of the outer bracket 250(1) proximate to the second end 254(1) of the outer bracket 250(1). The second bearing block 290(1) is coupled to the bottom portion 258(1) such that the second bearing block 290(1) extends substantially perpendicularly from the bottom portion 258(1) of the outer bracket 250(1). As illustrated in FIG. 4, the second bearing block 290(1) includes an opening 292(1). While not illustrated, a bearing is disposed within the opening 292(1) of the second bearing block 290(1). The second end 174(1) of the ball screw 170(1) is disposed through the opening 292(1) of the second bearing block 290(1) and into contact with the bearing disposed within the opening 292(1) of the second bearing block 290(1).

Figure 6:
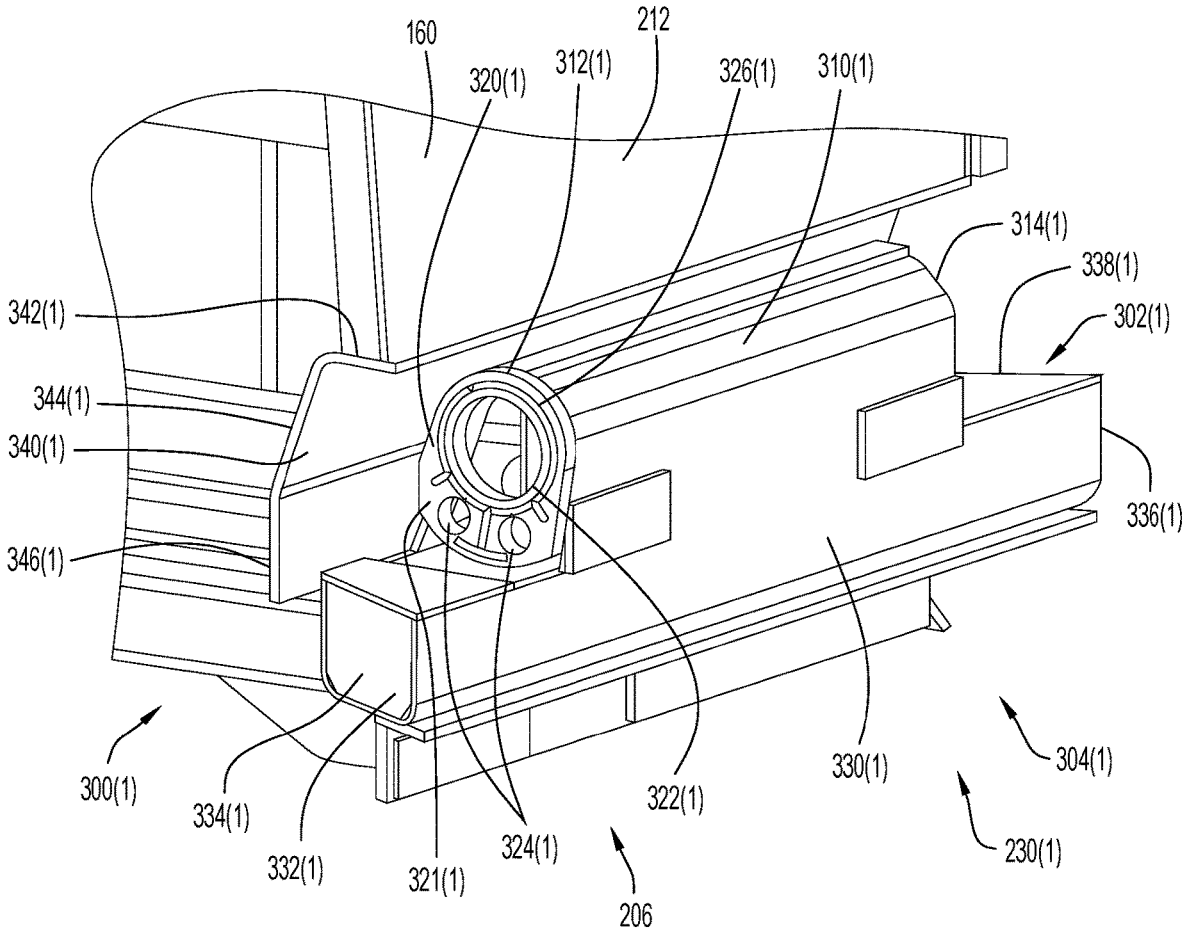
FIG. 6 illustrates an external cut-away perspective view the transfer plate of the transfer mechanism illustrated in FIG. 3A.

As previously explained, the transfer plate 230(1) is coupled to the first sidewall 212 of the packer blade 160 proximate to the bottom end 206 of the packer blade 160, while the second transfer plate 230(2) is coupled to the second sidewall 222 of the packer blade 160 proximate to the bottom end 206 of the packer blade 160 (see FIG. 3B). While the transfer plate 230(1) is illustrated in FIGS. 5, and 6, the discussion of the transfer plate 230(1) applies to the second transfer plate 230(2), which is a mirror image of the transfer plate 230(1). As best illustrated in FIG. 6, the transfer plate 230(1) includes a first end 300(1) and a second end 302(1) opposite the first end 300(1). The transfer plate 230(1) also includes an outer surface 304(1) (illustrated in FIG. 6) and an opposite inner surface 306(1) (illustrated in FIG. 5). The outer surface 304(1) is aligned with the sidewall 212 of the first side 210 of the packer blade 160. The transfer plate 230(1) includes an upper, or channel, portion 310(1) and a lower, or shuttle, portion 330(1). The upper portion 310(1) is substantially cylindrical in shape, while the lower portion 330(1) is substantially rectangular in shape. The upper portion 310(1) is disposed on top of, and integrally formed with, the lower portion 330(1).

As best illustrated in FIG. 6, the upper portion 310(1) includes a first end 312(1) and an opposite second end 314(1). The first end 312(1) of the upper portion 310(1) remains closer to the first end 242(1) of the first track 240(1) than the second end 314(1) of the upper portion 310(1) regardless of how far the transfer plate 230(1) has traveled along the first track 240(1). Disposed on the first end 312(1) of the upper portion 310(1) is a contact plate 320(1). The contact plate 320(1) is welded to the first end 312(1) of the upper portion 310(1). As illustrated in FIG. 6, the contact plate 320(1) includes a contact surface 321(1) in which a central opening 322(1) and two lower openings 324(1) are disposed. The central opening 322(1) is larger in diameter than the two lower openings 324(1), where the central opening 322(1) is sized to receive the ball screw 170(1). While not illustrated, the second end 314(1) also includes an opening substantially similar to the central opening 322(1) such that a channel 328(1) (see FIG. 5) extends through the upper portion 310(1) of the transfer plate 230(1). The central opening 322(1) of the contact plate 320(1), the channel 328(1), and the opening on the second end 314(1) are sized to receive the ball screw 170(1) such that the ball screw 170(1) may extend through the upper portion 310(1) of the transfer plate 230(1) while also being capable of rotating. The diameter of the central opening 322(1) is larger, for example, an inch larger than the diameter of the ball screw 170(1). As best illustrated in FIG. 5, a substantially square shaped aperture 329(1) is disposed on the upper portion 310(1) between the first end 312(1) and the second end 314(1) to provide access to the channel 328(1) of the upper portion 310(1) and the portion of the ball screw 170(1) disposed within the upper portion 310(1).

Furthermore, as illustrated in FIG. 6, the contact plate 320(1) includes a recessed channel 326(1) disposed within the contact surface 321(1) of the contact plate 320(1). The recessed channel 326(1) is disposed around the openings 322(1), 324(1), and is in fluid communication with the lower openings 324(1). As best illustrated in FIG. 5, a grease nipple 327(1) is disposed on the side of the contact plate 310(1) and in fluid communication with the recessed channel 326(1).

As illustrated in FIG. 6, the lower portion 330(1) is substantially rectangular, and includes a first end 332(1) and a second end 336(1). The first end 332(1) and the second end 336(1) of the lower portion 330(1) are spaced farther from one another than the first end 312(1) and the second end 314(1) of the upper portion 310(1). Thus, the lower portion 330(1) is longer in length than the upper portion 310(1). The first end 332(1) includes a first angled surface 334(1), while the second end 336(1) includes a second angled surface 338(1). The angled surfaces 334(1), 338(1) are angled such that the outer surface 304(1) of the lower portion 330(1) is longer in length than the inner surface 306(1) of the lower portion 330(1). The angled surfaces 334(1), 338(1) generally serves to divert or scoop debris away from the first track 240(1). For example, the angled surface 338(1) serves to divert or scoop debris away from the first track 240(1) and towards the front end 200 of the packer blade 160 as the packer blade 160 and the transfer plate 230(1) traverses the first track 240(1) toward the rear 104 of the truck 100.

Figure 8:
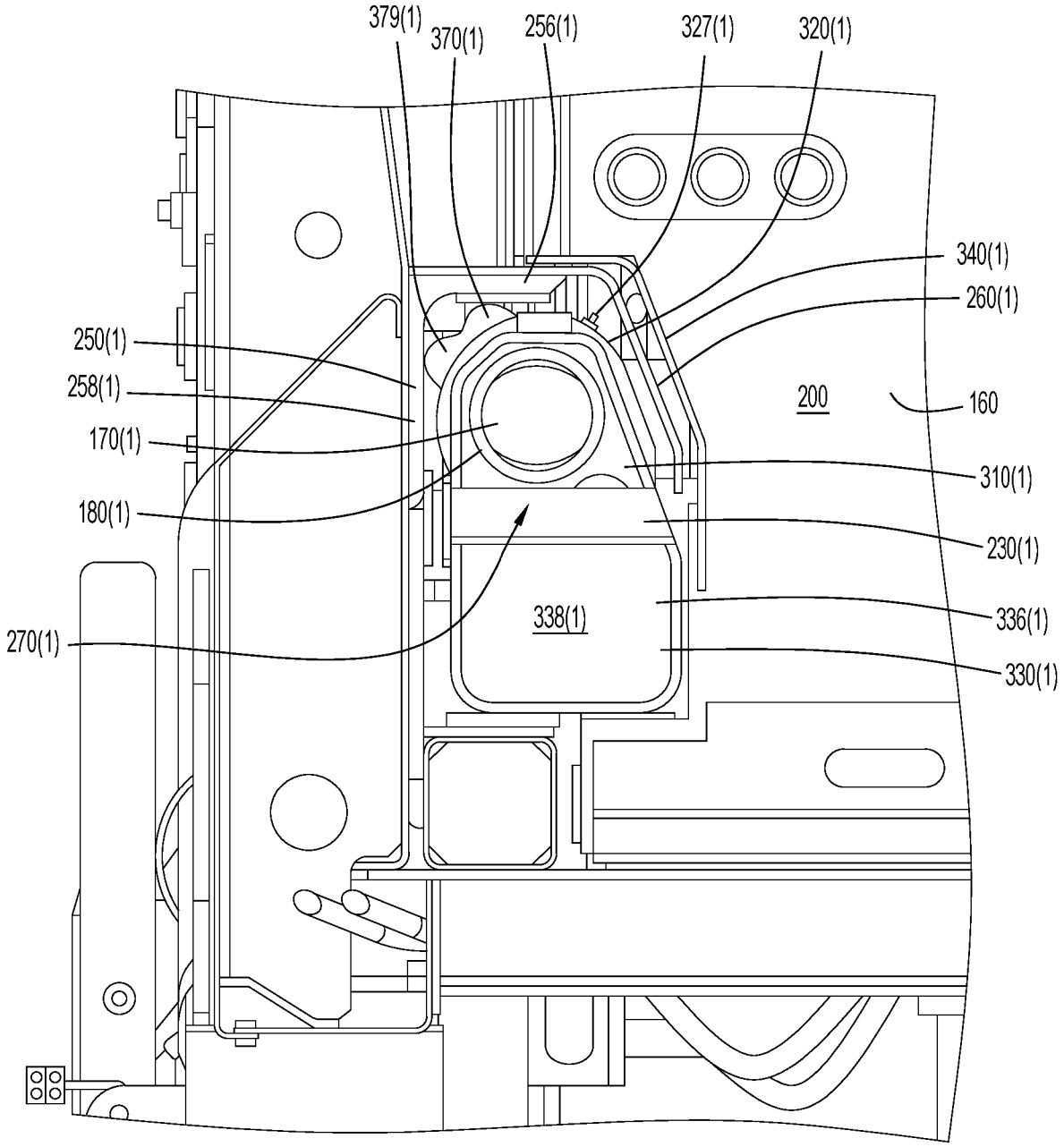
FIG. 8 illustrates a cross-sectional view of the transfer plate illustrated in FIG. 6 operably coupled to the track of the transfer mechanism illustrated in FIG. 2 and to the packer blade.

Also illustrated in FIGS. 5 and 6 is a cover plate 340(1). The cover plate 340(1) is disposed on the sidewall 212 of the packer blade 160, and covers the interior surface 306(1) of the transfer plate 230(1). The cover plate 340(1) is illustrated in phantom in FIG. 5 to illustrate the components of the transfer plate 230(1) that are covered by the cover plate 340(1). As best shown in FIG. 6, and similar to the debris cover 260(1), the cover plate 340(1) includes a top section 342(1), an intermediate section 344(1), and a bottom section 346(1). The top section 342(1) of the cover plate 340(1) is coupled to the sidewall 212 of the packer blade 160 such that the top section 342(1) is spaced from the top of the upper portion 310(1) of the transfer plate 230(1). The intermediate section 344(1) descends from the top section 342(1) at an angle offset from 90 degrees. Finally, the bottom section 346(1) descends from the intermediate section 344(1), such that the bottom section 346(1) is substantially vertical like that of the bottom portion 267(1) of the debris cover 260(1). As best illustrated in FIG. 5, a first substantially rectangular opening 348(1) is disposed on the intermediate section 344(1) proximate to the top section 342(1), where the first opening 348(1) provides access to the grease nipple 327(1) of the contact plate 320(1). A second substantially rectangular opening 349(1) is disposed on both the intermediate section 344(1) and the bottom section 346(1), where the second opening 349(1) provides access to the aperture 329(1) disposed on the upper portion 310(1) of the transfer plate 230(1). As best illustrated in FIGS. 5 and 8, as the packer blade 160 travels along the first track 240(1), the top portion 256(1) of the outer bracket 250(1) slides between the top of the upper portion 310(1) and the cover plate 340(1), while the debris cover 260(1) slides between the interior surface 306(1) of the transfer plate 230(1) and the cover plate 340(1).

Figure 7A:
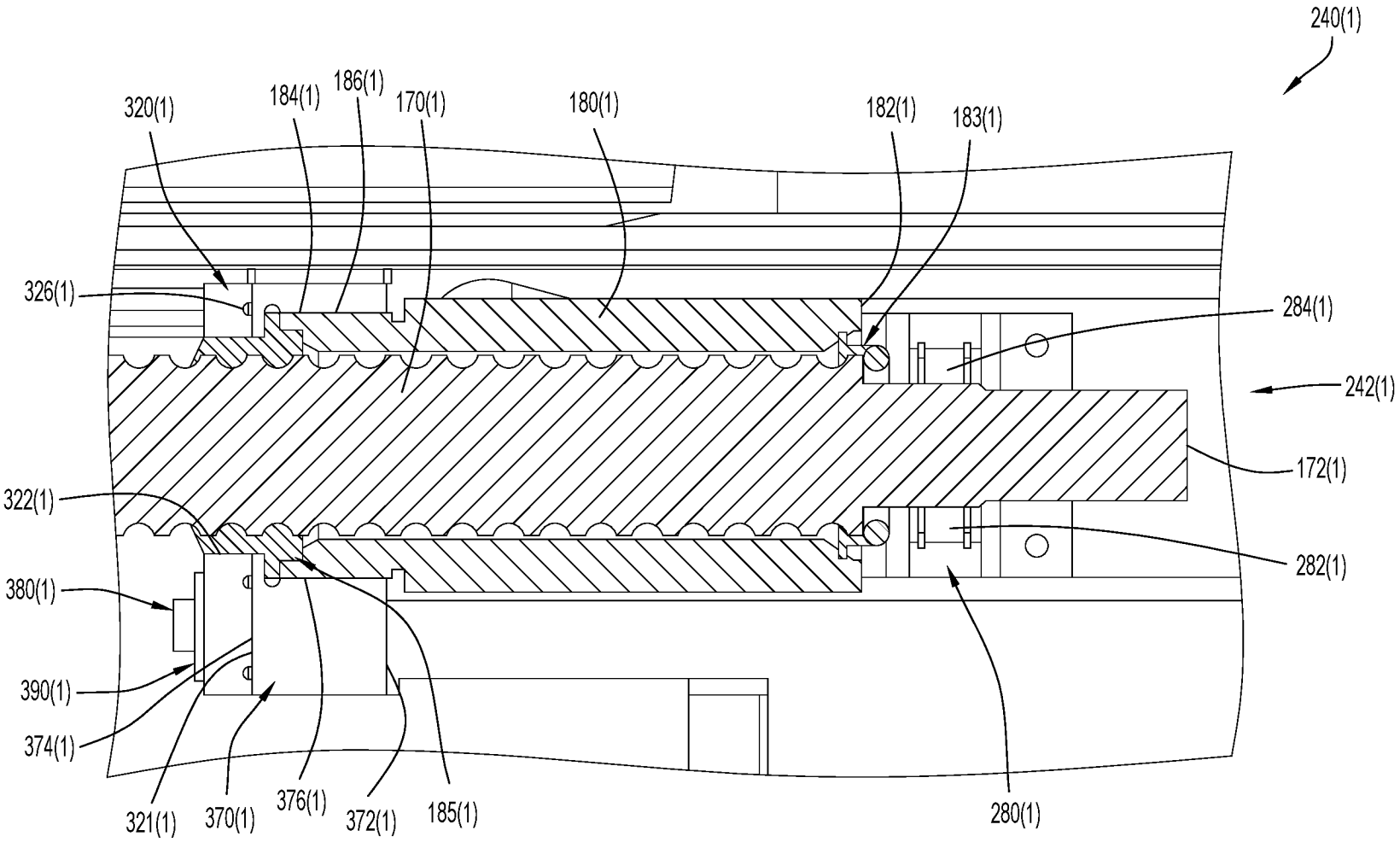
FIG. 7A illustrates a cross-sectional view of the transfer plate illustrated in FIG. 6 operably coupled to the track of the transfer mechanism illustrated in FIG. 2.
Figure 7B:
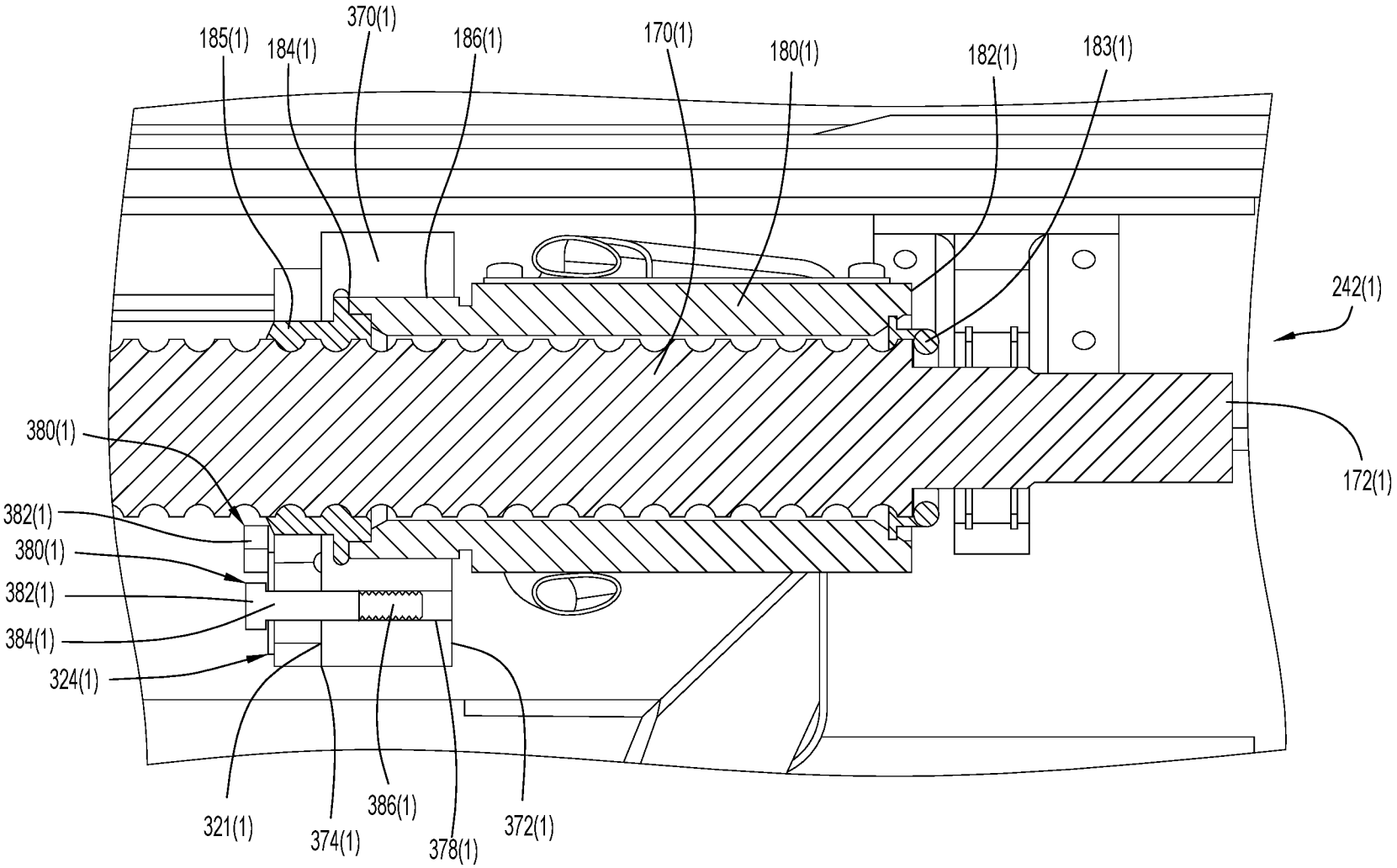
FIG. 7B illustrates a cross-sectional view of the ball nut operatively coupled to the transfer plate illustrated in FIG. 6.

Turning to FIGS. 5, 7A, and 7B, the ball nut 180(1) is disposed around the ball screw 170(1). The discussion of the ball nut 180(1) illustrated in FIGS. 5, 7A, and 7B also applies to the ball nut 180(2) illustrated in FIG. 3B because the ball nuts 180(1), 180(2) are substantially similar to one another. The ball nut 180(1) includes a first end 182(1) and a second end 184(1). The first end 182(1) of the ball nut 180(1) is disposed closer to the first end 242(1) of the track 240(1) than the second end 184(1) of the ball nut 180(1), while the second end 184(1) of the ball nut 180(1) is disposed closer to the second end 244(1) of the track 240(1) than the first end 182(1) of the ball nut 180(1).

As best illustrated in FIGS. 7A and 7B, a first wiper 183(1) is disposed between the first end 182(1) and the ball screw 170(1), while a second wiper 185(1) is disposed between the second end 184(1) and the ball screw 170(1). The wipers 183(1), 185(1) remain in contact with the ball screw 170(1) as the ball screw 170(1) rotates and the ball nut 180(1) travels along the ball screw 170(1). The wipers 183(1), 185(1) prevent debris from entering the space between the ball nut 180(1) and the ball screw 170(1) as the ball nut 180(1) travels along the ball screw 170(1) when the ball screw 170(1) is rotated.

As further illustrated in FIGS. 7A and 7B, the second end 184(1) of the ball nut 180(1) includes a set of threads 186(1). A flange plate 370(1) is threaded onto the second end 184(1) of the ball nut 180(1). The flange plate 370(1) contains a first surface 372(1), an opposite second surface 374(1), and a central opening 376(1) that extends through the flange plate 370(1) from the first surface 372(1) to the second surface 374(1). The central opening 376(1) is threaded such that, when coupled to the ball nut 180(1), the central opening 376(1) is screwed onto the second end 184(1) of the ball nut 180(1) via the set of threads 186(1). In addition, when coupled to the ball nut 180(1), the first surface 372(1) faces the ball nut 180(1), while the second surface 374(1) is disposed adjacent to, and may be in contact with, the contact plate 320(1). More specifically, the second surface 374(1) may be disposed adjacent to, and in contact with, the contact surface 321(1) of the contact plate 320(1).

In another embodiment, the second end 184(1) of the ball nut 180(1) may not include a set of threads, and the flange plate 370(1) may be friction fitted or adhered (e.g., via welding, glue, or another adhesive method) to the second end 184(1) of the ball nut 180(1).

Continuing with FIGS. 7A and 7B, a pair of bolts 380(1) loosely couple the flange plate 370(1) to the contact plate 320(1). Thus, with flange plate 370(1) being threaded to the second end 184(1) of the ball nut 180(1), the ball nut 180(1) is loosely coupled to the transfer plate 230(1) via the flange plate 370(1) being loosely coupled to the contact plate 320(1).

As best illustrated in FIG. 7B, the flange plate 370(1) includes a pair of openings 378(1) disposed below the central opening 376(1) of the flange plate 370(1) in a manner similar to that of the lower openings 324(1) of the contact plate 320(1). The lower openings 378(1) of the flange plate 370(1) are aligned with the lower openings 324(1) of the contact plate 320(1) such that bolts 380(1) can be inserted through the lower openings 324(1) of the contact plate 320(1) and threaded into the lower openings 378(1) of the flange plate 370(1). As best illustrated in FIG. 7B, the bolts 380(1) include a head portion 382(1), an unthreaded shank portion 384(1), and a threaded portion 386(1). When inserted through the lower openings 324(1) of the contact plate 320(1), the threaded portion 386(1) screws into the lower openings 378(1) of the flange plate 370(1), while the unthreaded shank portion 384(1) is disposed within the lower openings 324(1) of the contact plate 320(1).

The bolts 380(1) are of a length that they cannot be tightened to force the contact plate 320(1) against the flange plate 370(1) (i.e., there may be some play or float between the contact plate 320(1) and the flange plate 370(1)). The length of the bolts 380(1) enable some degree of float between the contact plate 320(1) and the flange plate 370(1), where the contact plate 320(1) is configured to slide along the unthreaded shank portion 384(1) between the head portion 382(1) and the threaded portion 386(1). The length of the bolts 380(1) enables the contact surface 321(1) of the contact plate 320(1) to float/slide up to a half inch in each direction (i.e., toward the second surface 374(1) of the flange plate 370(1), or away from the second surface 374(1) of the flange plate 370(1)).

Additionally, the lower openings 324(1) of the contact plate 320(1) are substantially larger that the unthreaded shank portion 384(1) of the bolts 380(1), but not large enough to allow the head portion 382(1) to pass there through. This allows some looseness between the contact plate 320(1) and the bolts 380(1) in a direction perpendicular to the longitudinal axis of the bolts 380(1).

Thus, while the ball nut 180(1) traverses along the ball screw 170(1), the contact surface 321(1) of the contact plate 320(1) may abut the second surface 374(1) of the flange plate 370(1), and may float away (e.g., up to an inch) from the second surface 374(1) of the flange plate 370(1). Grease disposed within the recessed channel 326(1) enables the contact plate 370(1) to freely float along the unthreaded shank portion 384(1) of the pair of bolts 380(1). As best illustrated in FIG. 7A, a washer 390(1) is disposed between the head portion 382(1) of the bolts 380(1) and the contact plate 320(1) to prevent the head portion 382(1) from shearing off of the bolts 380(1).

Returning to FIG. 5, as previously explained, the second opening 349(1) disposed on the cover plate 340(1) and the aperture 329(1) disposed on the upper portion 310(1) of the transfer plate 230(1) provide access to the channel 328(1) that extends through the upper portion 310(1) of the transfer plate 230(1). The second opening 349(1) of the cover plate 340(1) and the aperture 329(1) of the upper portion 310(1) of the transfer plate 230(1) also provide access to lower openings 324(1) of the contact plate 320(1) to enable insertion of the bolts 380(1) through the lower openings 324(1) of the contact plate 320(1) and tightening of the bolts 380(1) within the lower openings 378(1) of the flange plate 370(1).

Turning to FIG. 8, the flange plate 370(1) includes flange 379(1) that extends beyond the outer circumference of the contact plate 320(1) to contact both the top portion 256(1) and the bottom portion 258(1) of the outer bracket 250(1). As the ball screw 170(1) rotates, and the ball nut 180(1), flange plate 370(1), and transfer plate 230(1) traverse the first track 240(1) within the cavity 270(1) formed by the outer bracket 250(1) and the debris cover 260(1), the flange 379(1) contacts the top portion 256(1) and the bottom portion 258(2) of the outer bracket 250(1) to prevent the ball nut 180(1), flange plate 370(1), and transfer plate 230(1) from becoming misaligned within the cavity 270(1). Thus, the flange 379(1) of the flange plate 370(1) acts as a guide for the movement of the ball nut 180(1), flange plate 370(1), and transfer plate 230(1) through the cavity 270(1) of the first track 240(1).

In operation, the drive mechanisms 190(1), 190(2) (which could be a pair of electric motors), which are coupled to the first ends 172(1), 172(2) of the ball screws 170(1), 170(2), respectively, cause the ball screws 170(1), 170(2) to rotate in either a first, or clockwise, direction or a second, or counter-clockwise, direction about longitudinal axes A, B. The drive mechanisms 190(1), 190(2) may be electronically timed or coupled together via a controller, to operate simultaneously and to rotate the ball screws 170(1), 170(2) with the same speed. In another embodiment, the drive mechanisms 190(1), 190(2) may be operatively coupled to one another via a belt, chain, or other device to mechanically cause the drive mechanisms 190(1), 190(2) to simultaneously rotate the ball screws 170(1), 170(2) with the same speed.

As previously described, rotation of the ball screws 170(1), 170(2) causes the ball nuts 180(1), 180(2) to traverse along the ball screws 170(1), 170(2), respectively. When the ball screws 170(1), 170(2) rotate in the first direction about longitudinal axes A, B, the ball nuts 180(1), 180(2) traverse along the ball screws 170(1), 170(2) and along the tracks 240(1), 240(2) from the first ends 242(1), 242(2) of the tracks 240(1), 240(2) towards the second ends 244(1), 244(2) of the tracks 240(1), 240(2). Conversely, when the ball screws 170(1), 170(2) rotate in the second direction about longitudinal axes A, B, the ball nuts 180(1), 180(2) traverse along the ball screws 170(1), 170(2) and along the tracks 240(1), 240(2) from the second ends 244(1), 244(2) of the tracks 240(1), 240(2) towards the first ends 242(1), 242(2) of the tracks 240(1), 240(2).

As the ball nuts 180(1), 180(2) traverse along the ball screws 170(1), 170(2) in the first direction (i.e., from the first ends 242(1), 242(2) of the tracks 240(1), 240(2) towards the second ends 244(1), 244(2) of the tracks 240(1), 240(2)), the ball nuts 180(1), 180(2) push the transfer plates 230(1), 230(2), respectively, in the same direction. When the ball nuts 180(1), 180(2) traverse the ball screws 170(1), 170(2) in the first direction, the flange plates 370(1), 370(2) pushes the pairs of bolts 380(1), 380(2) through the lower openings 324(1), 324(2) of the contact plates 320(1), 320(2) until the second surfaces 374(1), 374(2) of the flange plates 370(1), 370(2) come in contact with the contact surfaces 321(1), 321(2) of the contact plates 320(1), 320(2). Once the second surfaces 374(1), 374(2) of the flange plates 370(1), 370(2) contact the contact surfaces 321(1), 321(2) of the contact plates 320(1), 320(2), the traversing of the ball nuts 180(1), 180(2) along the ball screws 170(1), 170(2) in the first direction pushes the transfer plates 230(1) in the same direction.

As previously explained, the first transfer plate 230(1) is coupled to the first sidewall 212 of the first side 210 of the packer blade 160, while the second transfer plate 230(2) is coupled to the second sidewall 222 of the second side 220 of the packer blade 160. Thus, as the ball nuts 180(1), 180(2) traverse the ball screws 170(1), 170(2), and push the transfer plates 230(1), 230(2) in the first direction, the packer blade 160 traverses the interior cavity 136 of the container 130 toward the second ends 244(1), 244(2) of the tracks 240(1), 240(2). When the packer blade 160 slides through the interior cavity 136 in the first direction (i.e., toward the second ends 244(1), 244(2) of the tracks 240(1), 240(2)), the front end 200 of the packer blade 160 contacts and presses against any debris or items (e.g., trash or refuse) disposed within the container 130. The rotation of the ball screws 170(1), 170(2) in the first direction causes the ball nuts 180(1), 180(2) to traverse the ball screws 170(1), 170(2) in the first direction so that the front end 200 of the packer blade 160 compacts or crushes any debris or items disposed within the container 130. The packer blade 160 may be sized such that the first side 210 and the second side 220 are spaced from the interior walls of the interior surface 132 by a half inch. Thus, a half inch of clearance may exist between each side 210, 220 of the packer blade 160 and the interior surface 132 of the container 130.

The debris or items disposed within the container 130, however, may not be substantially equal in size, shape, and/or structure. Thus, as the packer blade 160 is driven into the debris within the container 130, the forces experienced by the packer blade 160 may not be uniformly disposed across the front end 200 of the packer blade 160. The half inch of clearance on each side 210, 220 of the packer blade 160 enables the packer blade 160 to shift, cant, or twist within the interior cavity 136 of the container 130 as the packer blade 160 experiences different forces at different locations on the front end 200 of the packer blade 160. The loose coupling of the flange plates 370(1), 370(2) of the ball nuts 180(1), 180(2) to the contact plates 320(1), 320(2) of the transfer plates 230(1), 230(2) of the packer blade 160 creates a floating interface that connects the ball nuts 180(1), 180(2) to the packer blade 160.

The ability of the contact plates 320(1), 320(2) of the transfer plates 230(1), 230(2) to independently float or slide along the pairs of bolts 380(1), 380(2) coupled to the flange plates 370(1), 370(2) provides some degree of float (e.g., both side to side and front to back) for the packer blade 160 within the interior cavity 136 of the container 130. This enables the packer blade 160 to adjust to the different forces experienced by the front end 200 of the packer blade 160 without the ball nuts 180(1), 180(2) and ball screws 170(1), 170(2) experiencing sheer forces that would prevent the operation of, or damage, the ball nuts 180(1), 180(2) and ball screws 170(1), 170(2). Therefore, the ability of the transfer plates 230(1), 230(2) to independently float, to a degree, with respect to the flange plates 370(1), 370(2), which are coupled to the ball nuts 180(1), 180(2), enables the packer blade 160 to adjust, both laterally and longitudinally, to the contents of the container 130 as the packer blade 160 traverses in the first direction to compact or crush the contents of the container 130. This floating connection greatly reduces the likelihood of binding of the ball nut on the ball screw as the packer blade traverses within the container.

Conversely, as the ball nuts 180(1), 180(2) traverse along the ball screws 170(1), 170(2) in the second direction (i.e., from the second ends 244(1), 244(2) of the tracks 240(1), 240(2) towards the first ends 242(1), 242(2) of the tracks 240(1), 240(2)), the ball nuts 180(1), 180(2) pull the transfer plates 230(1), 230(2), respectively, in the same direction. When the ball nuts 180(1), 180(2) traverse the ball screws 170(1), 170(2) in the second direction, the flange plates 370(1), 370(2) pulls the unthreaded shank portions 384(1), 384(2) of the pairs of bolts 380(1), 380(2) through the lower openings 324(1), 324(2) of the contact plates 320(1), 320(2) to separate the second surfaces 374(1), 374(2) of the flange plate 370(1), 370(2) from the contact surfaces 321(1), 321(2) of the contact plates 320(1), 320(2). The flange plates 370(1), 370(2) pull the pairs of bolts 380(1), 380(2) through the lower openings 324(1), 324(2) of the contact plates 320(1), 320(2) until the head portions 382(1), 382(2) of the bolts 380(1), 380(2) contact the contact plates 320(1), 320(2), where, once the head portions 382(1), 382(2) of the bolts 380(1), 380(2) contact the contact plates 320(1), 320(2), the continuous movement of the ball nuts 180(1), 180(2) in the second direction causes the head portions 382(1), 382(2) of pairs of bolts 380(1), 380(2) to pull the transfer plates 230(1), 230(2) along with the ball nuts 180(1), 180(2).

As the ball nuts 180(1), 180(2) pull the transfer plates 230(1), 230(2) in the second direction, the contact surfaces 321(1), 321(2) of the contact plates 320(1), 320(2) remains spaced from the second surfaces 374(1), 374(2) of the flange plates 370(1), 370(2). Moreover, because the first transfer plate 230(1) is coupled to the first side 210 of the packer blade 160 and the second transfer plate 230(2) is coupled to the second side 220 of the packer blade 160, as the ball nuts 180(1), 180(2) pull the transfer plates 230(1), 230(2) in the second direction, the packer blade 160 is pulled in the second direction (i.e., toward the first ends 242(1), 242(2) of the tracks 240(1), 240(2)), and away from the compacted debris within the container 130.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A packer apparatus comprising:

a container defining a cavity;

a track disposed within the cavity;

a ball screw rotatably disposed within the track;

a ball nut operatively coupled around the ball screw, wherein rotation of the ball screw causes the ball nut to move along the ball screw; and a packer blade coupled to the ball nut via a floating interface, wherein movement of the ball nut along the ball screw forces the packer blade to move within the cavity of the container, and wherein the floating interface includes a bolt that loosely secures the packer blade to the ball nut such that the packer blade is able to float along a portion of the bolt with respect to the ball nut.

2. The apparatus according to claim 1, wherein the ball screw includes a first end and a second end.

3. The apparatus according to claim 2, wherein rotation of the ball screw in a first direction causes the ball nut to move along the ball screw towards the second end of the ball screw, and rotation of the ball screw in a second direction causes the ball nut to move along the ball screw toward the first end of the ball screw.

4. The apparatus according to claim 1, wherein the ball nut includes a first end and a second end.

5. The apparatus according to claim 4, wherein a flange is coupled to the second end of the ball nut.

6. The apparatus according to claim 5, further comprising a transfer plate coupled to the packer blade.

7. The apparatus according to claim 6, wherein the floating interface is formed by a loose coupling of the flange to a contact portion of the packer blade.

8. The apparatus according to claim 7, wherein the flange includes an opening, the contact portion of the packer blade includes an opening configured to be aligned with the opening of the flange, and the bolt of the floating interface is inserted through the opening of the contact portion and coupled to the opening of the flange.

9. The apparatus according to claim 8, the contact portion of the packer blade is configured to float along the bolt with respect to the flange.

10. A packer apparatus comprising:

a container including a plurality of sidewalls;

an elongated bracket disposed on one of the sidewalls, the elongated bracket spanning along a length of the container;

an elongated debris cover directly coupled to the elongated bracket and spanning along the length of the container, where the elongated bracket and the elongated debris cover collectively form an elongated longitudinal track that spans along the length of the container;

a ball screw rotatably disposed within the track;

a ball nut operatively coupled around the ball screw; and a packer blade coupled to the ball nut via a floating interface, wherein rotation of the ball screw causes the ball nut to move along the ball screw within the track, and movement of the ball nut along the ball screw forces the packer blade to move within the container.

11. The apparatus of claim 10, wherein the elongated bracket is L-shaped, and includes at least a horizontally oriented top portion and a vertically oriented bottom portion.

12. The apparatus of claim 11, wherein the elongated debris cover includes a horizontally oriented top section, a vertically oriented bottom section, and an angled intermediate section connecting the top section to the bottom section.

13. The apparatus of claim 11, wherein the top section of the elongated debris cover is directly coupled to the top portion of the elongated bracket, and the bottom section of the elongated debris cover is spaced laterally from the bottom portion of the elongated bracket to define the track.

14. The apparatus of claim 13, wherein the ball screw disposed within the track is disposed between the bottom portion of the elongated bracket and the bottom section of the elongated debris cover.

15. The apparatus of claim 10, wherein the elongated debris cover and the elongated bracket are configured to prevent items disposed within the container from contacting the ball screw.

16. A refuse truck comprising:

a container defining a cavity;

a transfer mechanism at least partially disposed within the cavity, the transfer mechanism comprising:

a track;

a ball screw rotatably disposed within the track;

a ball nut operatively coupled around the ball screw, wherein rotation of the ball screw causes the ball nut to move along the ball screw; and a packer blade coupled to the ball nut via a floating interface, wherein movement of the ball nut along the ball screw forces the packer blade to move within the cavity of the container, and wherein the floating interface includes a bolt that loosely secures the packer blade to the ball nut such that the packer blade is able to float along a portion of the bolt with respect to the ball nut.

17. The refuse truck according to claim 16, wherein the ball screw includes a first end and a second end, and further comprises:

a drive mechanism coupled to the second end of the ball screw, wherein the drive mechanism is configured to selectively rotate the ball screw about a longitudinal axis of the ball screw in both of a first direction and a second direction.

18. The refuse truck according to claim 16, wherein the track is a first track, the ball screw is a first ball screw, and the ball nut is a first ball nut, the transfer mechanism further comprising:

a second track spaced from the first track;

a second ball screw rotatably disposed within the second track; and a second ball nut operatively coupled around the second ball screw.

19. The refuse truck according to claim 18, wherein the floating interface is a first floating interface, the transfer mechanism further comprising:

a second floating interface, the packer blade being coupled to the second ball nut via the second floating interface.

20. The apparatus according to claim 1, wherein the floating interface enables the packer blade to float in a first direction along a longitudinal axis of the bolt and in a second direction that is perpendicular to the longitudinal axis.

* * * * *